United States Patent [19]

Webber

[11] Patent Number: 4,479,460

[45] Date of Patent: Oct. 30, 1984

[54] PRESSURE-VACUUM COOLING SYSTEM FOR INTERNAL COMBUSTION ENGINE UTILIZING RESERVOIR

[76] Inventor: Robert C. Webber, 908 Holoma Dr., Indian River Shores, Fla. 32960

[21] Appl. No.: 443,601

[22] Filed: Nov. 22, 1982

Related U.S. Application Data

[63] Continuation-in-part of Ser. No. 256,944, Apr. 23, 1981, abandoned, and a continuation-in-part of Ser. No. 304,832, Sep. 23, 1981, Pat. No. 4,414,926.

[51] Int. Cl.[3] ..... F01P 11/18

[52] U.S. Cl. ..... 123/41.27; 220/203; 220/85 VR

[58] Field of Search ..... 123/41.01, 41.02, 41.15, 123/41.27, 41.54, 41.21; 220/203, 303, DIG. 32, 85 VR, 85 VS, DIG. 9, 420, 421; 165/132, 148

[56] References Cited

U.S. PATENT DOCUMENTS

| | | | |
|---|---|---|---|
| 1,346,331 | 7/1920 | Muir | 123/41.21 |
| 1,643,511 | 9/1927 | Muir | 123/41.54 |
| 2,086,441 | 7/1937 | Rushmore | 123/41.27 |
| 2,147,699 | 2/1938 | Hardiman | 164/34 |
| 2,528,791 | 11/1950 | Scoville | 123/41.15 |
| 2,597,061 | 5/1952 | Burich | 123/41.15 |
| 2,672,853 | 3/1954 | Dunnigan | 123/41.27 |
| 2,841,127 | 7/1958 | Baster | 123/41.27 |
| 2,988,068 | 6/1961 | Waydak | 123/41.54 |
| 3,208,438 | 9/1965 | White | 123/41.5 |
| 3,397,808 | 8/1968 | Jones | 123/41.15 |
| 3,461,678 | 8/1969 | Klipping et al. | 220/421 |
| 3,576,181 | 4/1971 | Neal | 123/41.51 |
| 3,601,181 | 8/1971 | Avrea | 123/41.27 |
| 3,757,984 | 9/1973 | Barton | 123/41.54 |
| 3,765,383 | 10/1973 | Birdwell | 123/41.54 |
| 4,019,489 | 4/1977 | Cartmill | 123/41.15 |
| 4,079,855 | 3/1978 | Avrea | 220/203 |
| 4,167,159 | 9/1979 | Warman | 123/41.15 |
| 4,241,845 | 12/1980 | Daly et al. | 220/203 |
| 4,306,521 | 12/1981 | Giles | 123/41.15 |

*Primary Examiner*—William A. Cuchlinski, Jr.
*Attorney, Agent, or Firm*—Julian C. Renfro

[57] ABSTRACT

A coolant system for an internal combustion engine equipped with a radiator, involving the use of a reservoir utilized in a semi-hermetically sealed relationship with the engine and radiator, such that only rarely does additional coolant liquid need be added to the coolant system. This system has the safety of a pressure cap set to release in the pressure range of between 10 and 20 pounds per square inch, but no readmission valve is utilized in the cap, thus excluding unwanted atmospheric air from the coolant system. The reservoir is preferably insulated and of elongate configuration.

11 Claims, 10 Drawing Figures

FIG. 1
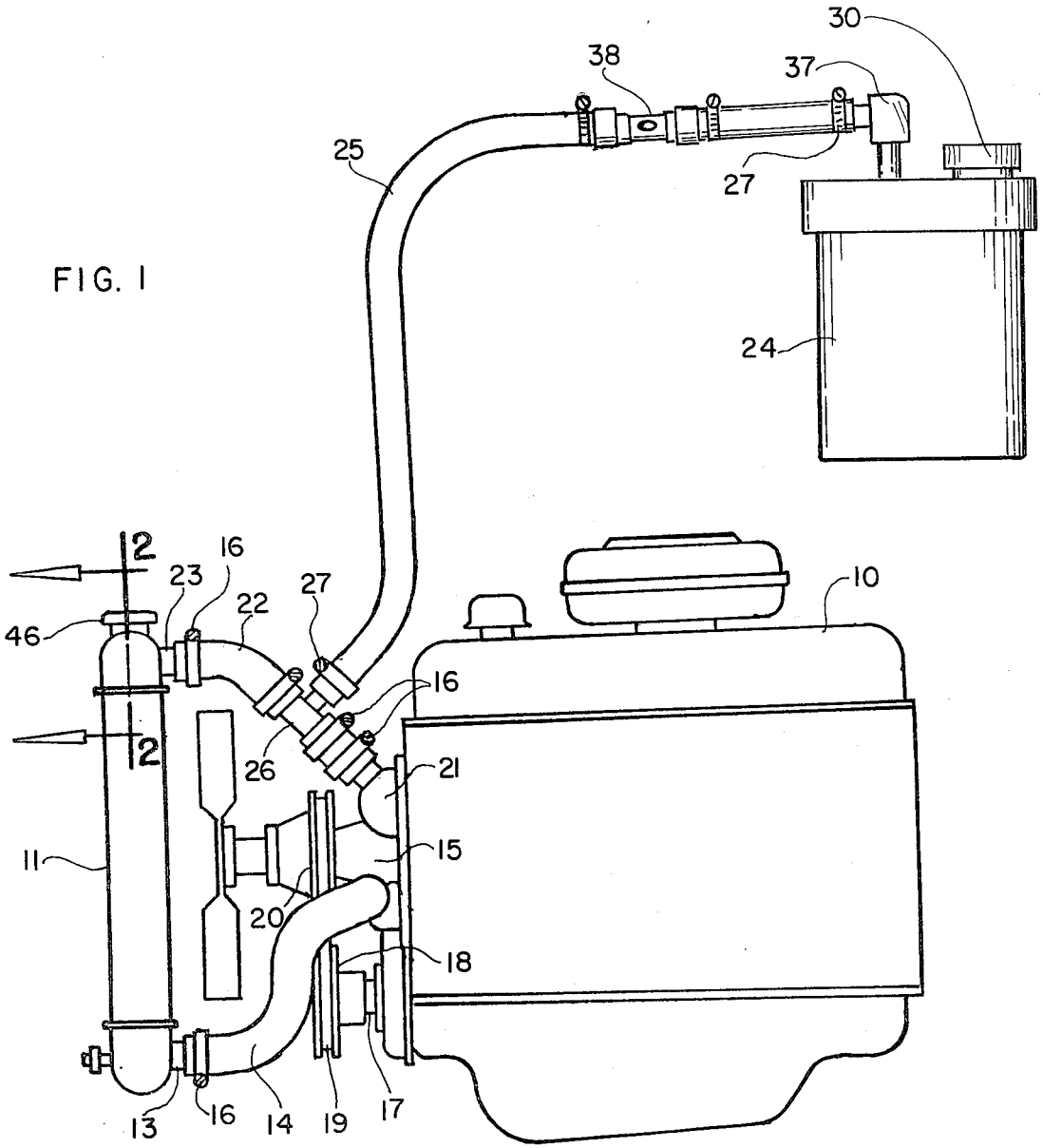
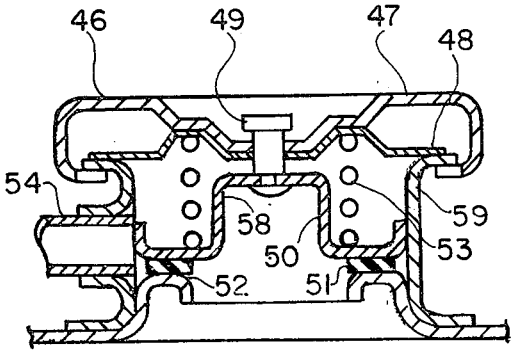
FIG. 2
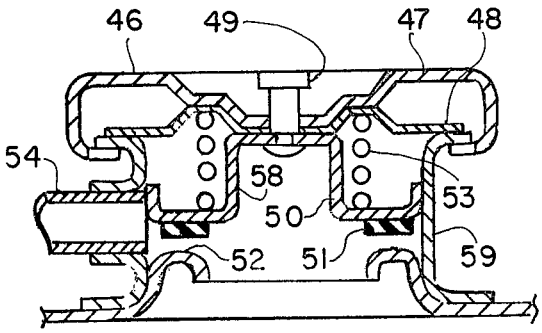
FIG. 3

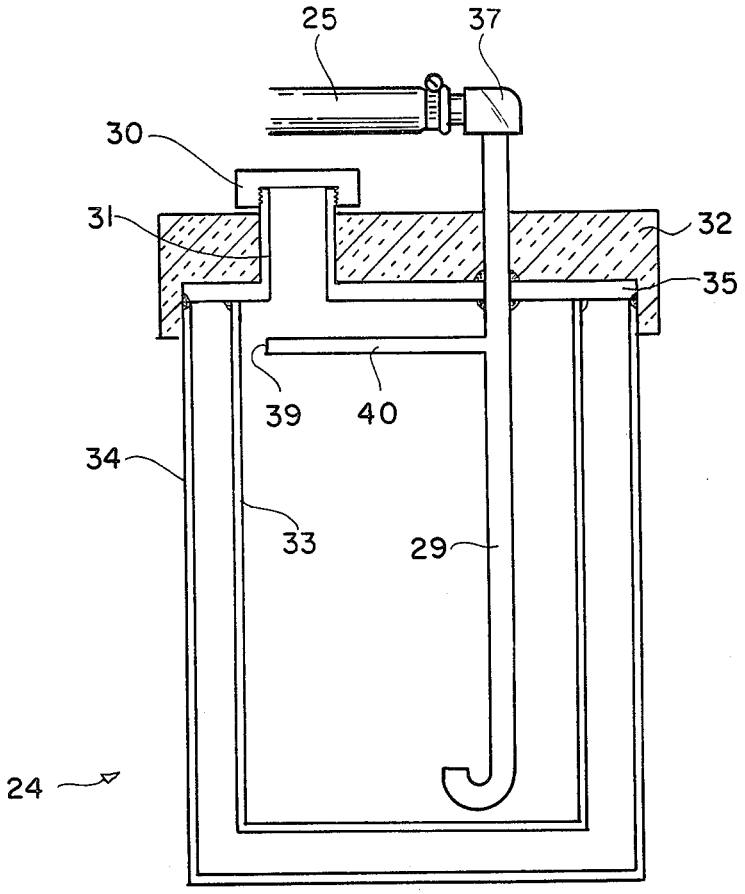
FIG. 6
FIG. 8
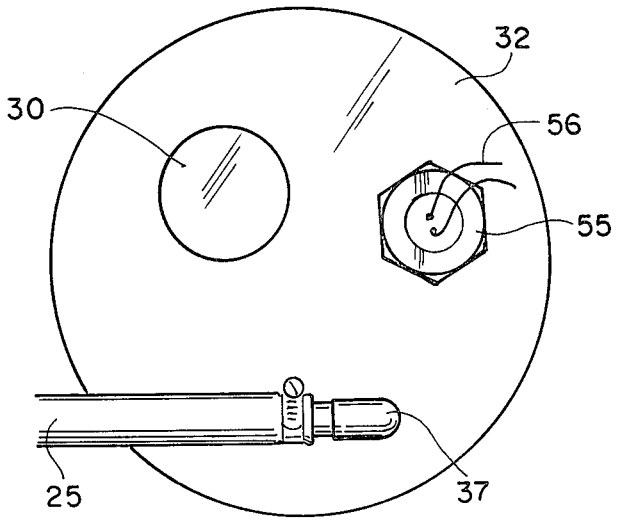
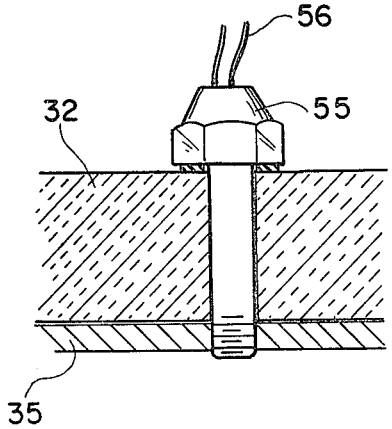
FIG. 7

PRESSURE-VACUUM COOLING SYSTEM FOR INTERNAL COMBUSTION ENGINE UTILIZING RESERVOIR

REFERENCE TO RELATED INVENTIONS

This invention may be regarded as a Continuation-in-Part of my copending U.S. Patent Application Ser. No. 256,944, filed Apr. 23, 1981 and entitled "Pressure-Vacuum Cooling System for Internal Combustion Engines" (now abandoned) as well as of my copending U.S. Patent Application Ser. No. 304,832, filed Sept. 23, 1981 and entitled "Engine Pressure-Vacuum Cooling System with a Horizontal Coolant Storage Tank" now U.S. Pat. No. 4,414,926.

BACKGROUND OF THE INVENTION

In the past a number of improved coolant systems for vehicle engines have been proposed, such as for automobiles, taxi cabs, trucks, buses and the like. Many prefer to utilize a permanent anti-freeze in their coolant systems on a year round basis, with any unecessary loss of coolant fluid representing a loss of money.

From time to time many radiators overheat, due for example to a build up of bugs on the radiator, sludge in the system, faulty thermostat or the like, so the utilization of a pressure relief arrangement in the radiator cap has been a must. In order to prevent the wasting of permanent anti-freeze, a large percentage of the vehicles on the road today are equipped with a plastic jug or reservoir located near the radiator and arranged to catch the coolant that flows out of an overheated radiator, or a radiator whose internal pressure has exceeded the force of the spring used in the cap. The pressure caps currently in use, in addition to permitting the release of fluid when the radiator has overheated, have an additional valve permitting the cooling system, when the engine has cooled and the pressure has dropped below atmospheric, to suck a substantial amount of the coolant back out of the plastic jug and into the radiator. Although these arrangements have been popular and advantageous in many respects, as a consequence of being continuously open to the atmosphere, they have many attendant disadvantages.

For example, a large amount of oxidation takes place in the coolant system since a substantial quantity of air exists in the coolant system when the engine is not running, and there is considerable opportunity for oxidation of metallic parts to take place.

It was to overcome the disadvantages of these prior art systems that the present invention was created.

SUMMARY OF THE INVENTION

In accordance with this invention, I have provided an arrangement that minimizes corrosion and the formation of sludge in a coolant system as a result of creating a semihermetically sealed system that, after being put into service, is normally never open to the atmosphere.

Instead of utilizing a plastic jug that is necessarily operating at ambient pressure at all times, I utilize a reservoir made either of heavy walled plastic or of metal, such that a pressure equal to that in the radiator and the coolant section of the engine block can be maintained at all times. As a consequence of this novel reservoir or storage tank for coolant, I can achieve a semi-hermetically sealed coolant system in which air is largely excluded, thus vastly decreasing the harmful effects of oxygen therein. This is to say, during normal operation, the interior of the reservoir can from time to time be at a pressure greater than atmospheric or less than atmospheric. Many tests I have conducted reveal that over a period of months or even years, the amount of sludge and/or rust buildup in my type of system is practically zero, resulting of course from the elimination of oxidation.

Although my semi-hermetically sealed radiator system can be exemplified by a number of different arrangements, in the preferred embodiment, I utilize a reservoir shielded from the heat of the engine, thereby representing more of an advantage to the coolant arrangement than would be the substitution of a radiator with a larger capacity in lieu of the original equipment radiator.

My invention is usable either as original equipment by the manufacturer, or for retrofit arrangements, but most importantly, its utilization does not in any way degrade the ability of the coolant system to release coolant in the instance of radiator boil over, so no jeopardy is involved in the utilization of my invention.

As pointed out in my above-cited copending applications, the reservoir can be of elongate configuration and installed either in a horizontal manner or a vertical manner. The radiator cap can still be set to release pressure upon some value such as 12 pounds per square inch or 15 pounds per square inch being reached. However, in accordance with my invention, the small valve conventionally used in the cap to later readmit coolant fluid to the radiator is entirely eliminated, thus preventing the readmission of air to the coolant system with its attendant disadvantages.

Although in some instances I may utilize a coolant system in which only a single fill cap it utilized, in retrofit operations I utilize a radiator cap (but with no readmission valve) as well as a reservoir equipped with a fill cap. Initially, both the radiator and the reservoir are filled with a suitable coolant fluid, and then both caps tightly applied. Then, during operation of the engine, some heating of the coolant fluid necessarily takes place, and during this phase, air is expelled or purged from the coolant system, this expulsion of air taking place through the radiator cap, at a pressure established by the cap manufacturer. It is entirely likely that a small quantity of coolant fluid will be lost during the purging of air from the system, but the amount lost is typically no more than half a pint for a passenger automobile, and once the purging of air has taken place, usually no further coolant fluid is lost. Thereafter, the coolant system is maintenance free for many months, if not for literally years.

Although principally described in conjunction with automotive use, my invention can also be used in trucks, buses, or even military tanks.

It is therefore a primary object of my invention to provide a highly satisfactory, hermetically sealed cooling sytem for an internal combustion engine.

It is another object of my invention to provide a novel coolant reservoir for use with an internal combustion engine, which serves as a most useful adjunct to the radiator provided as original equipment.

Another important object of my invention is to provide a coolant system for a motor vehicle in which means are provided for promptly ridding the coolant system of air, and then effectively preventing the entry of any further air into the coolant system, thus creating a semi-hermetically sealed system in which corrosion is minimized, but without impairing the ability of the system to release any dangerous overpressure occurring during engine operation.

Another object of my invention is to provide a semi-hermetically sealed system such that the need to flush or clean the radiator is eliminated, and the replacement of water pump, thermostat and/or raditor cap is rarely necessary for reasons of corrosion.

It is another object of my invention to greatly improve the cooling system of an internal combustion engine by replacing the conventional plastic overflow jug with a pressurized coolant reservoir, such that the cooling system becomes semi-hermetically sealed, with subsequent entry of corrosion-causing atmospheric air being prevented.

Another object of my invention is to provide a highly effective cooling system for an automobile, truck, bus, tank, or the like, wherein an oversize radiator, which might compromise an otherwise sleek design, becomes unnecessary by virtue of a novel, pressurized reservoir used in the cooling system, which reservoir is typically sheilded from the engine's heat, and which on certain occasions can serve as a source of relatively cool fluid to a radiator that has been overheating.

It is yet another object of my invention to provide a novel coolant reservoir which can be easily retrofitted to the cooling system of an automobile originally designed for use in temperate zones, increasing the capacity of the cooling system and thus making unnecessary any replacement of the original equipment radiator in an effort to cure frequent overheating of the system.

Still another object of my invention is to enable on a retrofit basis, a vehicle owner to achieve a semi-hermetically sealed coolant system that minimizes corrosion, which sealed system is achieved by closing off the conventional suction valve of the radiator cap, and replacing the customary plastic overflow jug with a sealed, preferably insulated reservoir for coolant.

Still another object is to provide an elongate reservoir which can be installed such that its principal axis is either horizontal or vertical, as may be preferred in a given instance.

These and other objects, features and advantages will be more apparent as the description proceeds.

BRIEF DESCRIPTION OF DRAWINGS

FIG. 1 is a side elevational view of an engine, illustrating the exterior of a reservoir in accordance with this invention, connected to the cooling system of the engine;

FIG. 2 is a sectional view taken along the lines 2—2 of FIG. 1, showing a pressure relief valve in the closed position;

FIG. 3 is a sectional view closely along the lines of FIG. 2, but with the pressure relief valve in the open position;

FIG. 6 is a showing to a larger scale of my novel reservoir in a vertical position, with the view being sectioned to reveal internal construction;

FIG. 7 is a showing to a still larger scale, of the type of device I may use to sense pressure inside the reservoir;

FIG. 8 is a showing of the top of the reservoir with the preferred placement of the fill cap, fluid connection, and pressure sensing device;

DESCRIPTION OF THE PREFERRED EMBODIMENT

Figure 4:
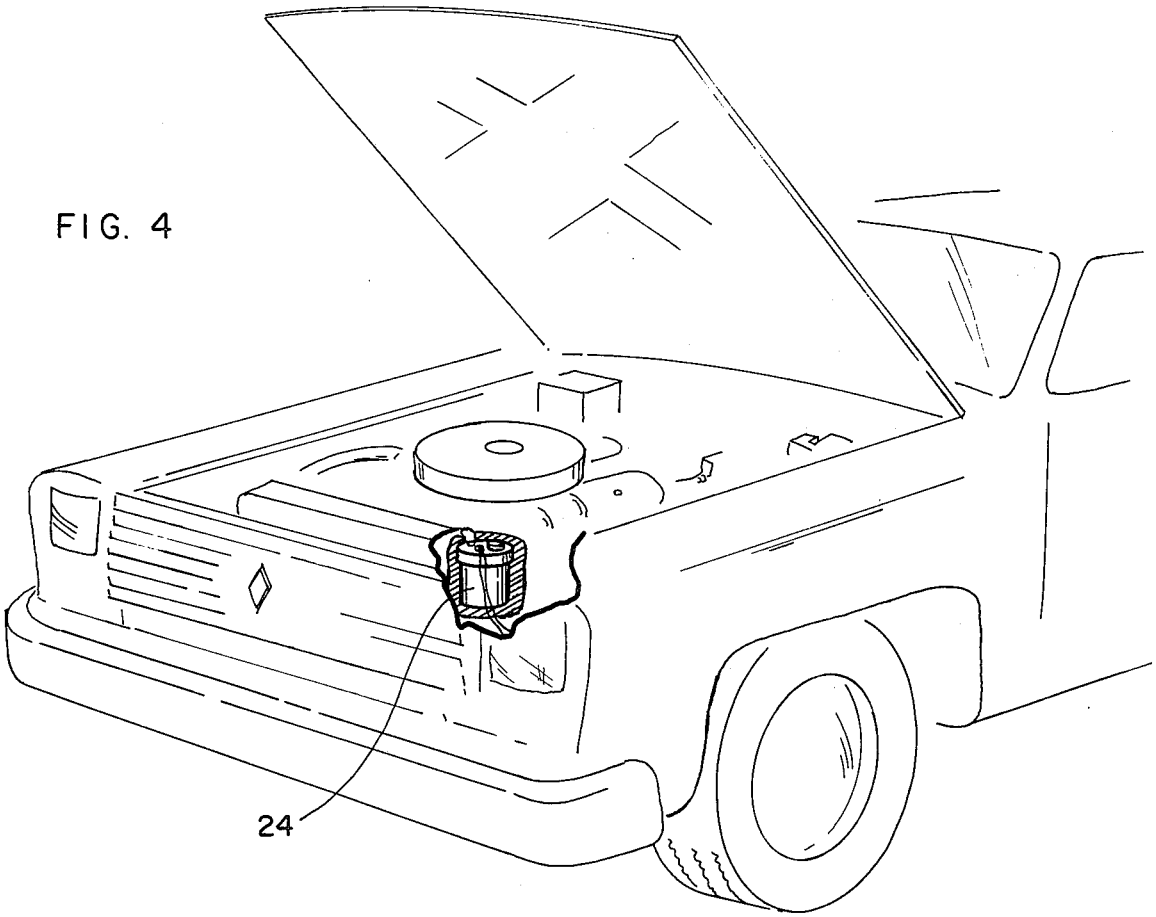
FIG. 4 is a perspective view of an automobile with the hood raised, with a portion of the insulation broken away to reveal the coolant reservoir used in a first position.

With reference to the accompanying drawings wherein like numerals refer to like and corresponding parts throughout the several views, the preferred embodiment of the invention is shown in combination with an internal combustion engine 10. The engine may be used for any purpose, such as a motor vehicle, boat, industrial use or the like.

A heat exchanger in the form of a radiator 11 is operably connected to the engine 10 such that a suitable coolant can be circulated therebetween. The coolant, preferably a 50/50 mixture of ethylene glycol and water, is pumped from an outlet 13 in the lower portion of the radiator 11 through a hose 14 to the low pressure side of the pump 15 and thereafter circulated through the engine 10 wherein it undergoes a temperature rise during engine operation, through the absorption of heat. A clamp 16 at each end of the lower radiator hose 14 provides leaktight connections for the coolant. The pump 15 is driven by the engine crankshaft 17 through a crankshaft pulley 18, a V-belt 19 and a pump pulley 20.

After circulating through the engine 10, the coolant exists through an outlet elbow 21 and returns to the radiator 11 through an upper hose 22, which may also be referred to as a connector fluid. The hose 22 is connected to the outlet elbow 21 and radiator inlet 23, in a similar manner as the lower hose 14. An engine thermostat, not shown, which is generally located immediately ahead of the outlet elbow 21, regulates the coolant flow from the engine 10 to the radiator 11. A by-pass means, not shown, located generally in or near the pump 15, by-passes the coolant which is diverted from the radiator 11 when the thermostat is not fully open. After entering the radiator 11, the coolant flows downwardly through a series of tubes whereby heat is rejected to the atmosphere and the coolant temperature is lower in a well understood manner.

My novel reservior or storage tank 24 has a fluid connection in the form of an elbow 37 connected to a hose or conduit means 25, as revealed in FIG. 1. This hose serves to interconnect the reservoir 24 with the remaining portion of the cooling system. The upper radiator hose or connector 22 is separated into two parts and a T-connector 26 is installed therebetween for attachment of the conduit means 25. The several clamps 16 are installed at the ends of the hose portions 22 to insure that the connections are leaktight, and clamps 27 are utilized at the ends of the hose or conduit 25, also to provide leaktight connections. I preferably use a sight glass 38 at a location in the conduit means 25 in which it will be most conveniently visible to the operator. Through its use, the operator can ascertain if the coolant system is full or not. Typically, bubbles will be seen in the sight glass if the system is low on coolant. The reservoir 24 forms an important part of this invention, and will be discussed at greater length hereinafter.

The pressure relief valve 50, shown in detail in FIG. 2, maintains and limits the pressure of the cooling system to the range of 10 to 20 psig, but preferably to about 15 psig. Integral with the radiator cap assembly 46, the relief valve 50 comprises a sleeve 58 slidable engaged with the radiator filler neck 59, a guide pin 49 attached to the top portion of the sleeve 58 and in slidable engagement with the cap housing 47, a compression spring 53 positioned between the cap housing 47 and lower flange of the sleeve 58, and a seal 51 affixed to the lower portion of the sleeve 58. The flat spring 48 retains the cap assembly 46 with its intergral pressure relief valve 50 to the upper flange portion of the radiator filler neck 59. FIG. 2 depicts the position of the relief valve 50 during normal operating conditions whereby the spring 53 is in an extended position and the seal 51 is tightly pressed against the seat 52 of the radiator 11.

In FIG. 3 the relief valve 50 is shown in the open position wherein the spring 53 is compressed by pressure acting against the valve sleeve 58 and the seal 51 is displaced from the seat 52 thereby allowing flow through the tube 54 projecting from the filler neck 59. It should be noted among the features which distinguish the present invention from other cooling systems is the absence of the vacuum relief valve used in the past to admit air when the internal system pressure falls below the level of the ambient pressure. This omission is deliberate, and advantageously makes possible herein the elimination of ambient air.

Figure 5:
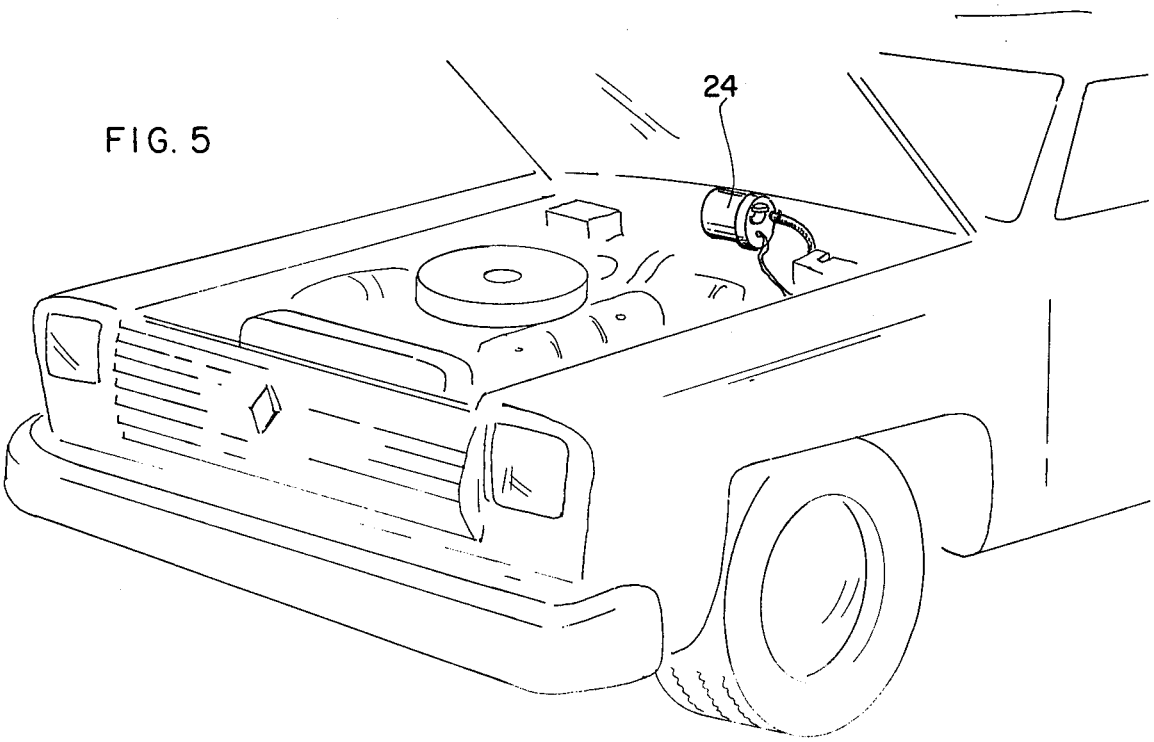
FIG. 5 is a perspective view generally resembling FIG. 4, but with the reservoir disposed in a horizontal position on the firewall of the engine compartment.

Turning to FIGS. 4 and 5, it will there be seen that I have illustrated how my novel reservoir or storage tank for the coolant system of a motor vehicle can be manufactured so as to be usable with its principal axis either in a vertical position or in a horizontal position. Typically, the vertical orientation of the principal axis of the enlongate reservoir, depicted in FIG. 4, is the preferred one, for it, generally speaking, requires less space for its installation. However, in a number of instances I have found that for one reason or another, a vertically oriented reservoir is not achievable, and in such instance a horizontal mounting as illustrated in FIG. 5 is the preferred one.

Rather than having to manufacture separate reservoirs in order to make possible the alternative mounting arrangements, I prefer for each reservoir to be constructed such that it may be properly installed in either the vertical or the horizontal orientation, with a preferred embodiment of my reservoir having double side walls. In this way, air can be evacuated from the space between the walls of the reservoir, thus inhibiting heat flow from the engine to the coolant contained in the reservoir. Also, the reservoir is preferably equipped with an insulated cover, for in this way the coolant contained in the reservoir is to a large extent isolated from the heat of the engine.

Optionally, I can dispense with the double wall arrangement, and use a reservoir protected by its remoteness from engine heat, such as being behind the front bumper, or in the luggage compartment, or in a walled off location in the engine compartment as depicted in FIG. 4, where thick, external insulation serves to protect the coolant in the reservoir from engine heat as well as ambient heat to a considerable extent.

Turning to FIG. 6, I have there illustrated a preferred embodiment of my reservoir 24 insulated from the heat of the engine by the use of double walls. In the typical instance, I will use large diameter copper tubing in the construction of this insulated version of my reservoir, with the tubing having one closed end. For example, the cylindrically shaped inner wall 33 of the reservoir as depicted in FIG. 6 can be made by a deep drawing procedure such that the bottom of the inner member is closed and the continuous sidewall is say five inches in diameter and six inches high. Inside the member 33 coolant is normally contained. I prefer for the reservoir to be of a size to contain approximately one-eighth of the total volume of the coolant system, but I am not to be limited to this.

In order that the space between the inner side wall and the outer side wall can be satisfactorily evacuated, I prefer during the construction of my reservoir to weld or braze the upper edge of the inner member 33 to circular metal plate 35, such as a plate six inches in diameter. The inner member is maintained in symmetrical relation to the plate 35, and a circumferential weld is brought about such that no leakage of air at the joinder location can take place. Before this welding step, however, pick-up tube 29 is securely welded in a leaktight manner to the circular plate 35. This tube is preferably essentially parallel to the vertical axis of the reservoir illustrated in FIG. 6, and its purpose will be discussed at greater length hereinafter.

After the inner cooper tube has been secured to the upper plate, it is then desirable to weld on the outer wall member 34 which in this instance may be a copper tube six inches in diameter, with its bottom wall closed. The member 34 may, for example, have a sidewall 6½ inches to 7 inches high. This sidewall, also, can be formed by a deep draw operation.

After the outer member has been positioned correctly with respect to the plate 35, the circular upper edge of the larger tube 34 is welded around its circumference to the upper plate 35, such that a continuous, airtight weld is achieved.

At this point, a space exists between the inner and outer side walls, and from this space the air can be evacuated, thus to achieve a reasonably high vacuum such that the heat transfer therethrough is minimized. This air withdrawal is accomplished through a suitable port (not shown) in the upper plate 35.

Although I prefer the inner and outer walls 33 and 34, and the upper plate 35 of the reservoir to be made of a suitable metal, it must be realized these members could be fabricated of plastic, and secured together in an airtight manner by use of a suitable cement.

So that additional coolant can be added to the reservoir if ever needed, I provide an elongate fill spout 31, which is welded to an aperture in the upper surface of the upper plate in an airtight manner. The upper end of the fill spout is threaded, such that a cap 30 whose interior is threaded can be used to tightly close off the fill spout when sufficient coolant has been added to the reservoir. Around this fill spout and the upper end of the pick-up tube 29, I utilize an inch or so of insulation 32. This insulation can for example be of high temperature epoxy, and lacquered or otherwise coated or covered if desired, so that a tough exterior will be provided.

It will be noted in FIG. 6 that the pick-up tube 29 is arranged to extend through the upper plate 35 to the elbow 37 as well as down within an inch or two of the bottom of the fluid containing portion of the reservoir. Rather than this tube being so located so as to pull up sludge or debris that may have reached the bottom of the fluid containing portion of member 33, I preferably configure the tube 29 such that its lower end is in somewhat of a hook shape, and as a result the sludge or debris would have to be say two inches deep in the reservoir before any of it could be pulled out of the reservoir, through the tubing and thence to the radiator of the vehicle. This tube preferably resides essentially parallel to the centerline of the cylindrically shaped reservoir.

It should be noted that in none of the many experiments I have conducted, have I found any sludge or the like to have been created, which I feel is a direct consequence of the effective exclusion of air as a result of the semi-hermetic seal I create. Therefore, it is to be understood that when I refer to the configuring of the tube 29 into a U-shaped or hook-shaped configuration, it is only in the context of avoiding the ingestion of sludge in a retrofit situation, that is, sludge remaining in the coolant system as a result of such system having previously been operated while exposed to atmospheric air, or in other words, before the installation of my novel reservoir arrangement.

So that any pocket of air can be readily removed from the reservoir, I provide a small aperture 39 near the entry point of tube 29 into the fluid-containing portion of the reservoir. Any air residing in the top interior portion of the reservoir will be pulled from the reservoir at the time of the initial running of the engine subsequent to the installation of my novel reservoir system. The preferred form of the aperture 39 is a short, ancillary tube 40 residing generally perpendicular to the tube 29, and in the same plane as the hook-shaped lower portion of the tube.

Referring now to FIG. 7, a sensor 55 sensitive to pressure is shown extending through the upper insulation 32 of the reservoir 24, with the lower portion of the sensor 55 in threaded engagement with a suitable aperture in the upper plate or closure 35. The sensor 55, preferably of conventional construction, via a pair of wires 56 actuates an audio or visual warning means, not shown, when the system internal pressure reaches a level of concern to the operator. In the typical instance, I will utilize a compound gauge on the dashboard so that the operator will be made aware of the pressure condition, either greater or less than atmospheric, that exists in the coolant system at any given moment. Although I prefer the use of an electrical type sensor-pressure gauge arrangement, I can instead use a non-electrical arrangement, in which case a mechanical type pressure sensor 55 may be connected to the dashboard gauge by a capillary tube or the like. Also, the sensor selected can be utilized in the T-connector 26 instead of in the top of the reservoir, if desired.

It is conceivable in areas of low ambient temperatures, in instances in which the present invention has been retrofitted to existing vehicles, that strengthened radiators and hoses may be required to withstand the high system vacuums when the engine is inoperative, but this will be relatively rare. It is apparent that where the present invention is adapted to new vehicles, components can be provided at the vehicle manufacturing source to withstand vacuums occuring for all ambient conditions.

The relationships of the sensor 55, the fill cap 30 and the elbow 37 of the pick-up tube 29 are made clear by FIG. 8. It will there be noted that the hose or conduit means 25 is positioned such that it does not interfere with removal or replacement of the cap 30.

Figure 9:
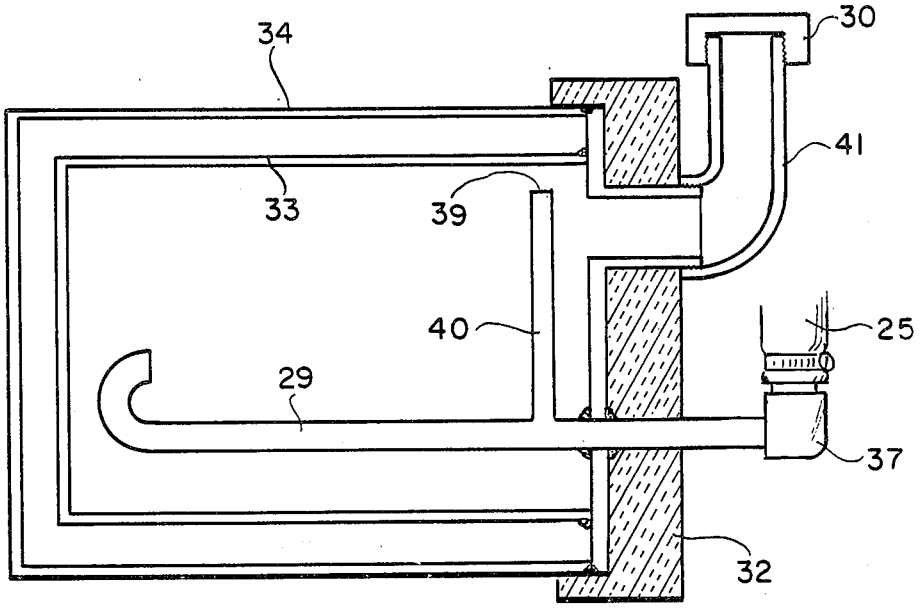
FIG. 9 is a cross sectional view of my reservoir, as it would be utilized in a horizontal position.

Turning to FIG. 9, it will be seen that virtually the identical reservoir depicted in FIG. 6 can be used in a horizontal mount, for as was true in the preceding case, because of the hook-shaped arrangement at the remote end of the tube 29, any sludge residing in the interior of the horizontal embodiment would need to be more than an inch or two deep before any of it could be pulled through the tubing into the radiator. Also, the small inlet aperture 39 used near the entry point of the tube 29 into the interior of the reservoir can, as before, be used to remove any air otherwise trapped in the liquid-containing portion of the reservoir, for the short ancillary tube 40 extends upwardly near the top of the sidewall 33. It is desirable, on the outside of my reservoir, to indicate to the purchaser of same, the rotational orientation that should be resorted to when the reservoir is being mounted horizontally. Otherwise, the hook shaped portion as well as the short tube 40, which are preferably coplanar, might not be positioned correctly, which is the position in which both are directed upwardly when the reservoir or storage tank is disposed with its principal axis horizontal.

Although the fill cap could conceivably still be located directly on the top of the upper cover, in the horizontal mounting I prefer to use an elbow 41 that can be added easily to the end of the fill spout 31 by the purchaser so that the filling of the reservoir is simplified. For example, I can provide a 90 elbow with the reservoir 24 at the time it is sold, such that a purchaser desiring to mount the reservoir horizontally can attach the elbow contemporaneously with the mounting of the reservoir on the firewall, or other appropriate place on the automobile. In this way, filling the reservoir with coolant will always be a simple matter.

Figure 10:
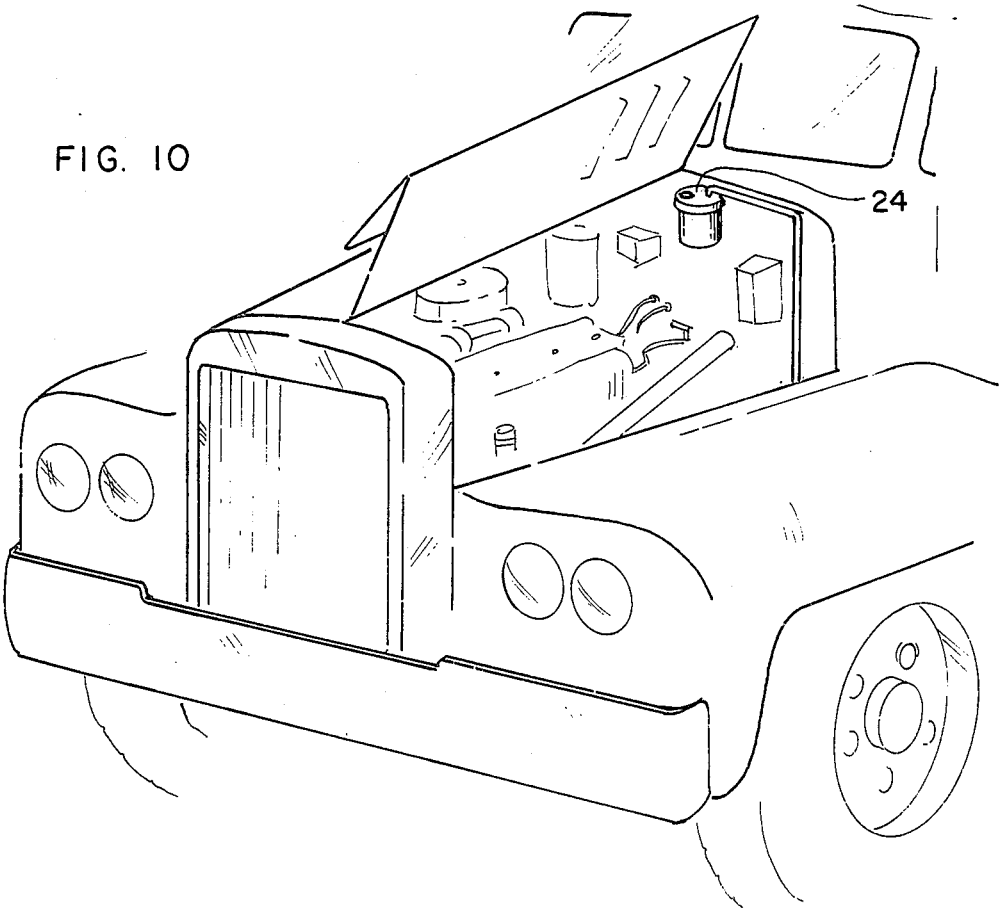
FIG. 10 is a showing of the front of a truck with its hood open to reveal the reservoir utilized in the highest point of the coolant system.

Turning to FIG. 10, it will be seen that I have shown how my novel reservoir can be mounted so as to be located at the highest point of the coolant system. In this instance the reservoir is located high on the firewall of a truck's engine compartment. The same reservoir is used as in the automotive embodiment, except that in some instances it may be substantially larger. When the reservoir is mounted higher than the radiator (and any other component associated with the flow of coolant), the radiator cap can largely remain unused, for all filling of the coolant system can now take place at the reservoir. It is to be understood that when a thermally insulated reservoir is desired for auto, truck, bus, or tank applications, either the double walled version depicted in FIGS. 6 and 9, or else a reservoir covered with insulation, may be utilized.

Although not specifically depicted herein, it is to be understood that various ancillary aspects of my novel cooling system may, if desired, be utilized in a given embodiment of my invention. For example, a coolant level indicator may be utilized as an optional feature of my reservoir. When the reservoir is being mounted in the vertical attitude illustrated in FIG. 6, a coolant level indicator attached to the fill cap 30 may be utilized. This coolant level indicator may be patterned after the device 31 disclosed in my copending application Ser. No. 256,994, (now abandoned) and the teachings of the application, as well as the teachings of my allowed copending application Ser. No. 304,832 are hereby incorporated by reference into this application.

I claim:

1. A pressure-vacuum cooling system for an internal combustion engine equipped with a radiator, wherein the cooling system is semi-hermetically sealed and may have on occasion a pressure less than atmospheric pressure, and wherein a connector for fluid is interposed between the engine and the radiator, through which connector, liquid coolant flows when the engine is operating, said system including conduit means attached to the connector and to a storage tank for coolant, said storage tank having insulation means such that its contents are shielded from the heat of the engine and/or ambient heat, said insulation means involving double sidewalls, with the space between said sidewalls evacuated, conduit means forming a path for coolant to flow on occasion between the radiator and engine on the one hand, and said storage tank on the other, a removable cap which, when removed, enables additional liquid, when needed, to be added to said cooling system, said cap having therein a one way valve set to open in the pressure range of between 10 and 20 pounds per square inch when the engine is operating and the coolant has been heated thereby, said cap when in place, effectively preventing the admission of any atmospheric air to the cooling system after the engine has thereafter ceased operation and the liquid coolant has cooled, such that a pressure below ambient may be maintained in the system.

2. A pressure-vacuum cooling system for an internal combustion engine equipped with a radiator, wherein the cooling system may have on occasion a pressure less than atmospheric pressure, a connector for fluid interposed between the engine and the radiator, through which connector liquid coolant flows where the engine is operating, said system including conduit means attached to the connector and to a generally elongate storage tank for coolant, said conduit means forming a path for coolant to flow on occasion between the radiator and engine on the one hand, and said storage tank on the other, a removable cap which, when removed, enables additional liquid, when needed, to be added to said cooling system, said cap having therein a one way valve set to open in the pressure range of between 10 and 20 pounds per square inch when the engine is operating and the coolant has been heated thereby, said cap when in place, effectively preventing the admission of any atmospheric air to the cooling system after the engine has thereafter ceased operation and the liquid coolant has cooled, said storage tank containing in its interior a tube through which liquid coolant can enter or leave, said tube being connected to said conduit means and disposed substantially parallel to the conterline of said storage tank, and orifice means in said tube near the point of its entry into the interior of said storage tank, said orifice means facilitating the removal of any air trapped in said storage tank at such time as the liquid coolant becomes heated as a result of engine operation, irrespective of said storage tank being utilized in a generally-vertical, or a generally-horizontal position.

3. The pressure-vacuum cooling system as defined in claim 2 wherein said tube has a hook-shaped portion, and said orifice means is located in a short tube disposed generally in the plane of said hook-shaped portion.

4. The pressure-vacuum cooling system as defined in claim 2 wherein insulating means is utilized to shield said storage tank from engine and/or ambient heat.

5. the pressure-vacuum cooling system as defined in claim 4 wherein double sidewalls represent said insulating means, the space between which sidewalls is evacuated.

6. The pressure-vacuum system as defined in claim 4 wherein said insulating means in represented by external insulation.

7. A reservoir for use in conjunction with a semi-hermetically sealed coolant system for an internal combustion engine have a radiator, said reservoir having a generally cylindrical inner chamber with closed ends, in which inner chamber liquid coolant may be held at pressures either higher or lower than atmospheric, said generally cylindrical inner chamber being surrounded by a generally cylindrical outer chamber having closed ends, at least one fluid connection from said radiator to said inner chamber, such that liquid coolant may either be added to, or removed from, said inner chamber, the space between said chambers being evacuated such that the liquid contents of said inner chamber may to a considerable extent be insulated from heat from the engine, or from ambient sources.

8. The reservoir as defined in claim 7 in which a tube is mounted inside said inner chamber, which tube connects to said fluid connection, and serves as the ingress and egress of coolant to or from said inner chamber, said tube having a hook-shaped lower portion spaced away from the bottom as well as away from the sidewall of said inner chamber, thus diminishing the likelihood of sludge being drawn into the cooling system of the engine, irrespective of the utilization of the reservoir in a generally-horizontal, or generally-vertical position.

9. The reservoir as defined in claim 8 in which said tube is equipped with an orifice adjacent the entry location of said tube into said inner chamber, such that any air trapped inside said inner chamber can be removed readily.

10. The reservoir as defined in claim 8 wherein an orifice for air removal is provided in said tube, said orifice being located in a short, ancillary tube located generally in the plane of said hook-shaped lower portion, and disposed near the entry location of said tube into said inner chamber, such orifice enabling the ready removal of air from said inner chamber.

11. The reservoir as defined in clain 7 wherein pressure sensing means is utilized such that a signal may be given to an operator as to the pressure in said inner chamber.

* * * * *